US007499013B2

(12) United States Patent
Ito

(10) Patent No.: US 7,499,013 B2
(45) **Date of Patent: *Mar. 3, 2009**

(54) DISPLAY DRIVER, ELECTRO-OPTICAL DEVICE AND DRIVE METHOD

(75) Inventor: Satoru Ito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 681 days.

This patent is subject to a terminal disclaimer.

(21) Appl. No.: 10/954,054

(22) Filed: Sep. 30, 2004

(65) Prior Publication Data

US 2005/0093811 A1 May 5, 2005

(30) Foreign Application Priority Data

Oct. 10, 2003 (JP) ..... 2003-352648

(51) Int. Cl.
*G09G 3/36* (2006.01)

(52) U.S. Cl. ..... 345/98; 345/87; 345/100

(58) Field of Classification Search ..... 345/88–100, 345/204–215

See application file for complete search history.

(56) References Cited

U.S. PATENT DOCUMENTS 4,926,166 A 5/1990 Fujisawa et al.
5,321,811 A * 6/1994 Kato et al. ..... 345/520
6,262,705 B1 * 7/2001 Inoue et al. ..... 345/100
6,636,194 B2 10/2003 Ishii
2002/0075220 A1 6/2002 Murakami
2002/0190973 A1 12/2002 Morita

FOREIGN PATENT DOCUMENTS

JP A-06-266310 9/1994
JP A-09-006278 1/1997
JP A-11-338427 12/1999
JP A-2001-305510 10/2001
JP A 2002-351412 12/2002
JP A-2003-157057 5/2003
WO WO 00/08625 A1 2/2000

* cited by examiner

*Primary Examiner*—Vijay Shankar
(74) *Attorney, Agent, or Firm*—Oliff & Berridge, PLC

(57) ABSTRACT

A display driver which drives at least a plurality of scan lines of a liquid crystal device, the display panel including the scan lines, a plurality of data lines, and a plurality of pixels, includes an address generation circuit, a plurality of scan drive cells, and a plurality of coincidence detection circuits. The address generation circuit includes a scan order storage circuit in which scan line addresses are stored corresponding to a scan order, and outputs the scan line addresses stored in the scan order storage circuit. Each of the scan drive cells drives one of the scan lines. Each of the coincidence detection circuits is connected with one of the scan drive cells, and outputs to the one of the scan drive cells a result of comparison between an address exclusively assigned to each of the scan drive cells and one of the scan line addresses output from the address generation circuit.

19 Claims, 18 Drawing Sheets

DISPLAY DRIVER, ELECTRO-OPTICAL DEVICE AND DRIVE METHOD

Japanese Patent Application No. 2003-352648, filed on Oct. 10, 2003, is hereby incorporated by reference in its entirety.

BACKGROUND OF THE INVENTION

The present invention relates to a scan driver, an electro-optical device, and a drive method.

A liquid crystal panel is used as a display section of an electronic instrument such as a portable telephone. In recent years, a still image and a moving image valuable as information have been distributed accompanying widespread use of portable telephones. Therefore, an increase in the image quality of the liquid crystal panel has been demanded.

An active matrix liquid crystal panel using a thin-film transistor (hereinafter abbreviated as "TFT") is known as a liquid crystal panel which realizes an increase in the image quality of a display section of an electronic instrument. The active matrix liquid crystal panel using the TFT realizes high response time and high contrast in comparison with a simple matrix liquid crystal panel using a dynamically driven super twisted nematic (STN) liquid crystal, and is suitable for displaying a moving image or the like (see Japanese Patent Application Laid-open No. 2002-351412).

However, since the active matrix liquid crystal panel using the TFT consumes a large amount of electric power, power consumption must be reduced in order to employ the active matrix liquid crystal panel as a display section of a battery-driven portable electronic instrument such as a portable telephone. An interlace drive method is known to reduce power consumption. A comb-tooth drive method which reduces coloring errors in each display pixel is also known. The interlace drive method is a drive method suitable for displaying a still image, since the image quality is decreased when applied to a moving image.

Therefore, a driver circuit which can deal with various drive methods such as a normal drive, interlace drive, and comb-tooth drive is demanded for a display panel (liquid crystal panel, for example) which displays a still image and a moving image.

BRIEF SUMMARY OF THE INVENTION

According to one aspect of the present invention, there is provided a display driver which drives at least a plurality of scan lines of a display panel, the display panel including the scan lines, a plurality of data lines, and a plurality of pixels, the display driver comprising:

an address generation circuit; a plurality of scan drive cells; and a plurality of coincidence detection circuits, wherein the address generation circuit includes a scan order storage circuit in which scan line addresses are stored corresponding to a scan order, and outputs the scan line addresses stored in the scan order storage circuit, wherein each of the scan drive cells drives one of the scan lines, and wherein each of the coincidence detection circuits is connected with one of the scan drive cells, and outputs to the one of the scan drive cells a result of comparison between an address exclusively assigned to each of the scan drive cells and one of the scan line addresses output from the address generation circuit.

According to another aspect of the present invention, there is provided a drive method for driving at least a plurality of scan lines of a display panel by using a plurality of scan drive cells, the display panel including the scan lines, a plurality of data lines, and a plurality of pixels, the drive method comprising:

storing scan line addresses corresponding to a scan order in a scan order storage circuit of an address generation circuit;

comparing an address exclusively assigned to each of the scan drive cells with one of the scan line addresses output from the address generation circuit, and outputting a comparison result to each of the scan drive cells; and driving each of the scan lines by corresponding one of the scan drive cells.

DETAILED DESCRIPTION OF THE EMBODIMENT

Figure 1:
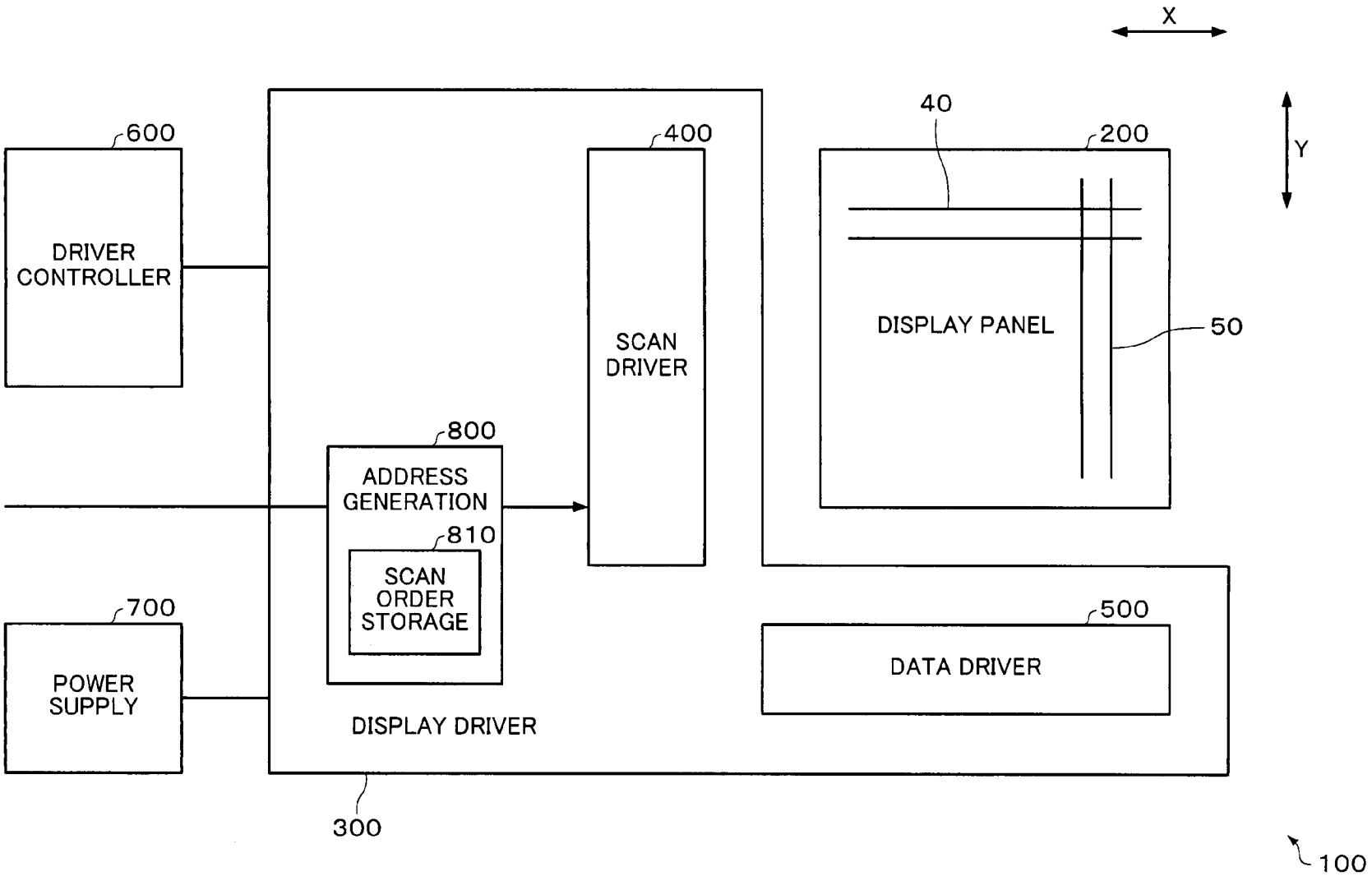
FIG. 1 is an overall diagram according to an embodiment of the present invention.

Embodiments of the present invention are described below.

According to one embodiment of the present invention, there is provided a display driver which drives at least a plurality of scan lines of a display panel, the display panel including the scan lines, a plurality of data lines, and a plurality of pixels, the display driver comprising:

an address generation circuit; a plurality of scan drive cells; and a plurality of coincidence detection circuits, wherein the address generation circuit includes a scan order storage circuit in which scan line addresses are stored corresponding to a scan order, and outputs the scan line addresses stored in the scan order storage circuit, wherein each of the scan drive cells drives one of the scan lines, and wherein each of the coincidence detection circuits is connected with one of the scan drive cells, and outputs to the one of the scan drive cells a result of comparison between an address exclusively assigned to each of the scan drive cells and one of the scan line addresses output from the address generation circuit.

This display driver can drive the scan lines in an arbitrary order by storing the scan line addresses in the scan order storage circuit in the arbitrary order. Therefore, the display driver can flexibly deal with various drive methods.

The display driver may comprise a scan line address bus for supplying the scan line addresses.

With this configuration, since each of the coincidence detection circuits can be connected with the scan line address bus, corresponding one of the scan lines can be driven according to the output from the address generation circuit.

In the display driver, the scan line address bus may include a plurality of address signal lines, and a combination of connecting each of the coincidence detection circuits with the address signal lines may differ between each of the coincidence detection circuits.

With this configuration, one of the scan lines to be ON-driven can be selected from among the scan lines due to the connection combination of the address signal lines and each of the coincidence detection circuits.

In the display driver, at least an N address signal line (N is an integer equal to or greater than one) among the address signal lines may be connected with at least one of the coincidence detection circuits, and each of the coincidence detection circuits may include a logic circuit having at least an N input.

With this configuration, since the address supplied through the N address signal line selected from among the address signal lines can be calculated by using the logic circuit, one of the scan drive cells corresponding to each of the scan line addresses can be determined.

In the display driver, when one of the coincidence detection circuits determines that one of the scan line addresses supplied from the address generation circuit coincides with the address exclusively assigned to one of the scan drive cells, the one of the scan drive cells may drive corresponding one of the scan lines.

With this configuration, one of the scan lines to be ON-driven can be selected from among the scan lines.

In the display driver, when none of the scan lines are selected, the address generation circuit may output to each of the coincidence detection circuits an address other than the address assigned to each of the scan drive cells.

With this configuration, the display panel can be driven without changing a circuit of the display driver, even if the number of the scan lines of the display panel is smaller than the number of the scan drive cells in the display driver.

In the display driver, the address generation circuit may include a counter, and the scan order storage circuit may sequentially output the stored scan line addresses based on the counter.

With this configuration, the address generation circuit can sequentially supply the scan line addresses stored in the scan order storage circuit to the scan driver without requiring a complicated signal from the outside of the address generation circuit.

In the display driver, the scan order storage circuit may include a scan order storage ROM in which the scan line addresses are stored corresponding to a scan order, and the address generation circuit may output the scan line address stored in the scan order storage ROM.

With this configuration, the scan line addresses can be supplied to the scan driver in an order corresponding to a desired drive method.

In the display driver, the scan order storage circuit may include a scan order storage RAM in which the scan line addresses are stored corresponding to a scan order, and the address generation circuit may output the scan line address stored in the scan order storage RAM.

With this configuration, information stored in the scan order storage RAM can be easily rewritten.

In the display driver, the scan order storage circuit may include a scan order storage RAM and a scan order storage ROM in which the scan line addresses are stored corresponding to a scan order, information stored in the scan order storage ROM may be supplied to the scan order storage RAM at the time of power-on, and the address generation circuit may output the information which has been supplied to the scan order storage RAM.

With this configuration, a display driver which can flexibly meet various requirements can be provided.

In the display driver, the scan line addresses may be sequentially written into the scan order storage circuit in an ascending order or a descending order, and after a last scan line address among the scan line addresses is written into the scan order storage circuit, an address other than the address assigned to each of the scan drive cells may be written into the scan order storage circuit.

With this configuration, the address which causes none of the scan lines to be driven can be supplied to the scan driver.

In the display driver, each of the coincidence detection circuits may include at least one of an output-enable-input and an output-fix-input, each of the coincidence detection circuits may ON-drive corresponding one of the scan drive cells in a period in which an active signal is input to the output-fix-input, and each of the coincidence detection circuits may OFF-drive corresponding one of the scan drive cells in a period in which a non-active signal is input to the output-enable-input.

With this configuration, the scan drive cells can be ON-driven or OFF-driven independently of contents of the scan line addresses.

According to another embodiment of the present invention, there is provided an electro-optical device comprises:

one of the above display drivers;

a display panel driven by the display driver; and a controller which controls the display driver.

According to a further embodiment of the present invention, there is provided a drive method for driving at least a plurality of scan lines of a display panel by using a plurality of scan drive cells, the display panel including the scan lines, a plurality of data lines, and a plurality of pixels, the drive method comprising:

storing scan line addresses corresponding to a scan order in a scan order storage circuit of an address generation circuit;

comparing an address exclusively assigned to each of the scan drive cells with one of the scan line addresses output from the address generation circuit, and outputting a comparison result to each of the scan drive cells; and driving each of the scan lines by corresponding one of the scan drive cells.

With this configuration, the scan lines can be driven in an arbitrary order.

The drive method may comprise outputting from the address generation circuit an address other than the address assigned to each of the scan drive cells to each of the coincidence detection circuits, when none of the scan lines are selected.

With this configuration, the scan lines can be prevented from being driven.

The embodiments of the present invention are described below with reference to the drawings. Note that the embodiments described below do not limit the scope of the invention defined by the claims laid out herein. In addition, not all of the elements of the embodiments described below should be taken as essential requirements of the present invention.

1. Electro-Optical Device

FIG. 1 shows an outline of a configuration of an electro-optical device including a display driver in the present embodiment. FIG. 1 shows a liquid crystal device as an example of an electro-optical device. A liquid crystal device 100 may be incorporated into various electronic instruments such as a portable telephone, portable information instrument (such as PDA), wearable information instrument (such as wrist watch type terminal), digital camera, projector, portable audio player, mass storage device, video camera, on-board display, on-board information terminal (car navigation system or on-board personal computer), electronic notebook, or global positioning system (GPS).

The liquid crystal device 100 includes a display panel 200 (optical panel), a display driver 300, a driver controller 600, and a power supply circuit 700. The display driver 300 includes a scan driver 400 (gate driver), a data driver 500 (source driver), and an address generation circuit 800. The address generation circuit 800 includes a scan order storage circuit 810. The scan order storage circuit 810 may be formed by a ROM, RAM, or nonvolatile memory (electrically erasable programmable nonvolatile memory). The scan order storage circuit 810 is described later.

The liquid crystal device 100 does not necessarily include all of these circuit blocks. The liquid crystal device 10 may have a configuration in which some of the circuit blocks are omitted. The data driver 500 and the address generation circuit 800 in the present embodiment may be disposed outside the display driver 300. The display driver 300 may be configured to include the driver controller 600.

In the drawings, sections denoted by the same symbols have the same definitions.

The display panel 200 includes a plurality of scan lines 40 (gate lines), a plurality of data lines 50 (source lines) which intersect the scan lines 40, and a plurality of pixels, each of the pixels being specified by one of the scan lines 40 and one of the data lines 50. In the case where one pixel consists of three color components of RGB, one pixel consists of three dots, one dot each for R, G, and B. The dot may be referred to as an element point which makes up each pixel. The data lines 50 corresponding to one pixel may be referred to as the data lines 50 in the number of color components which make up one pixel. The following description is appropriately given on the assumption that one pixel consists of one dot for convenience of illustration.

Each pixel includes a thin-film transistor (hereinafter abbreviated as "TFT") (switching device in a broad sense), and a pixel electrode. The TFT is connected with the data line 50, and the pixel electrode is connected with the TFT.

The display panel 200 is formed by a panel substrate such as a glass substrate. The scan lines 40 formed along the row direction X shown in FIG. 1 and the data lines 50 formed along the column direction Y shown in FIG. 1 are arranged so that the pixels arranged in a matrix can be appropriately specified. The scan lines 40 are connected with the scan driver 400. The data lines 50 are connected with the data driver 500.

The address generation circuit 800 generates a scan line address corresponding to a desired scan line 40, and supplies the scan line address to the scan driver 400. The scan driver 400 drives one of the scan lines 40 corresponding to the scan line address according to a control signal from the driver controller 600 and the scan line address from the address generation circuit 800. Therefore, the present embodiment can deal with various scan drive methods. As the scan drive method, a normal drive (line sequential drive), a comb-tooth drive, an interlace drive, and the like can be given.

2. Address Generation Circuit

Figure 2:
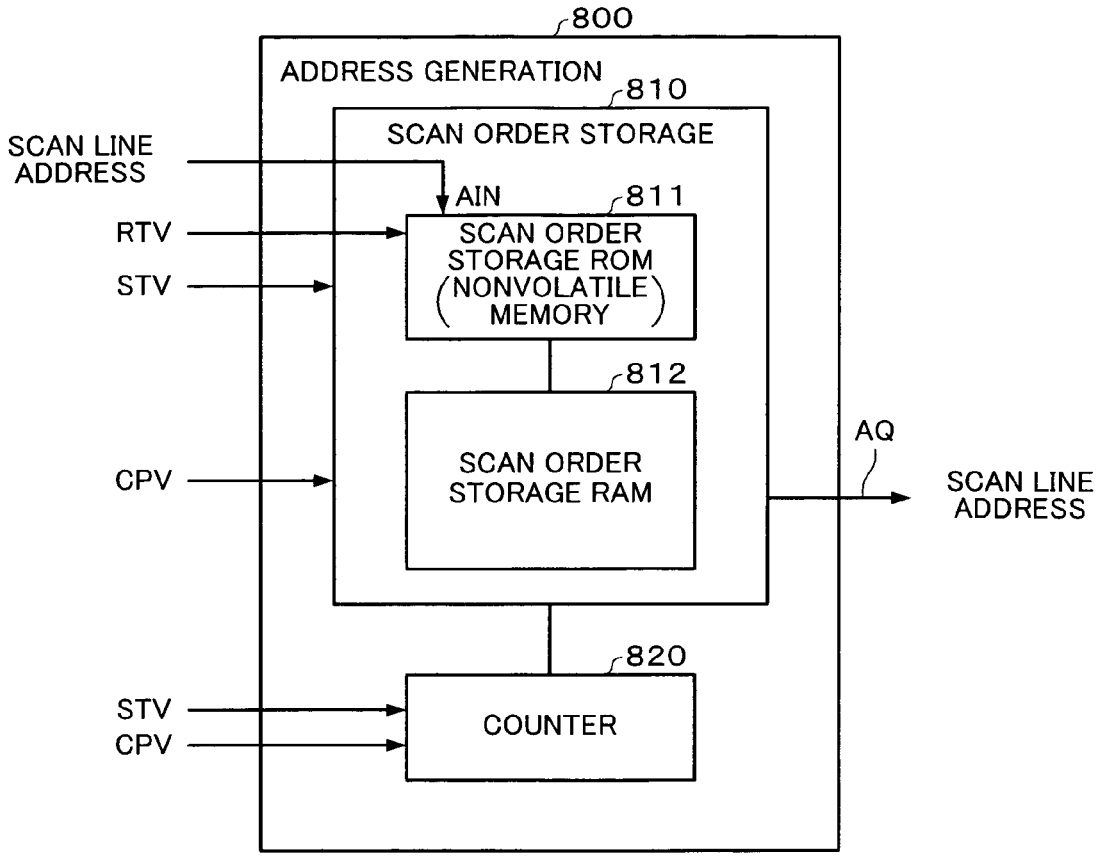
FIG. 2 is a block diagram of an address generation circuit according to an embodiment of the present invention.

FIG. 2 shows a configuration of the address generation circuit 800. The address generation circuit 800 includes the scan order storage circuit 810 and a counter 820. The scan order storage circuit 810 includes a scan order storage ROM 811 and a scan order storage RAM 812. The scan order storage ROM 811 is formed by an EEPROM.

A symbol STV denotes a scan start signal. The scan start signal STV is a signal supplied from the driver controller 600 when starting a scan. A symbol CPV denotes a scan clock signal. A symbol RTV denotes a write clock signal. A symbol AQ denotes a scan line address output. The scan line address output AQ is connected with the scan driver 400. A symbol AIN denotes a scan line address input.

The scan order storage ROM 811 includes the scan line address input AIN. The scan line address is input to the scan line address input AIN at the time of initialization according to the order corresponding to the scan drive method (interlace drive, for example), and the scan line address is written into the scan order storage ROM 811.

The scan order storage ROM 811 may be formed by a mask ROM.

When power is supplied to the liquid crystal device 100, the scan line address stored in the scan order storage ROM 811 is supplied to the scan order storage RAM 812 in the scan order storage circuit 810.

When the scan start signal STV is supplied to the scan order storage circuit 810 and the counter 820, the counter 820 starts supplying a RAM address to the scan order storage RAM 812. Since the RAM address output from the counter 820 corresponds to the internal address of the scan order storage RAM 812, the counter 820 designates the internal address of the scan order storage RAM 812 by supplying the RAM address.

The scan order storage RAM 812 outputs the scan line address stored at the internal address of the scan order storage RAM 812 designated by the counter 820 to the scan line address output AQ based on the scan start signal STV and the scan clock signal CPV.

The details of the scan order storage circuit 810 are described below with reference to FIG. 3.

Figure 3:
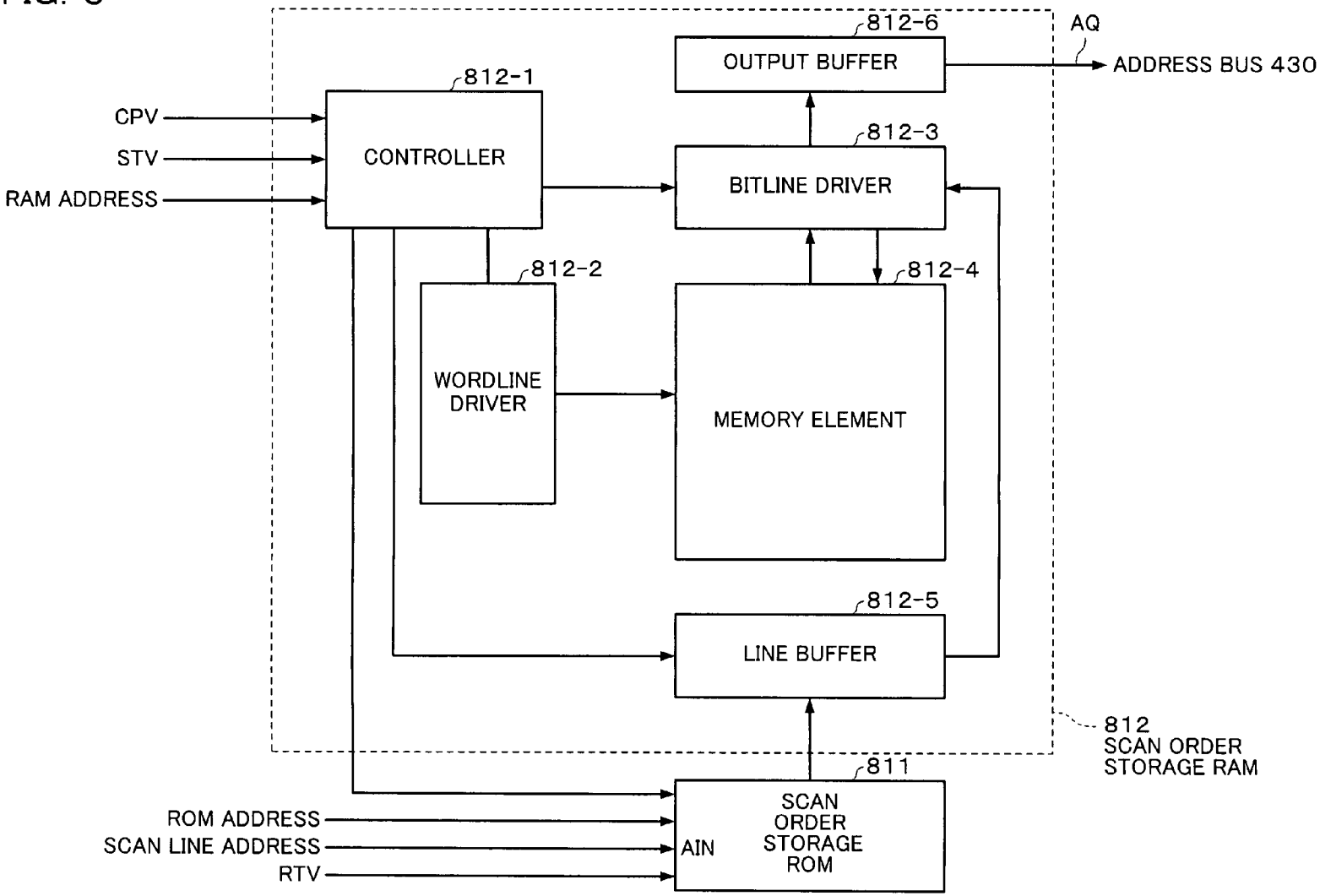
FIG. 3 is a block diagram of a scan order storage circuit according to an embodiment of the present invention.

FIG. 3 shows the details of the scan order storage RAM 812 and the scan order storage ROM 811. The scan order storage RAM 812 includes a controller 812-1, a wordline driver 812-2, a bitline driver 812-3, a memory element 812-4, a line buffer 812-5, and an output buffer 812-6.

The scan start signal STV, the scan clock signal CPV, and the RAM address are input to the controller 812-1. The controller 812-1 controls the wordline driver 812-2, the bitline driver 812-3, the line buffer 812-5, and the scan order storage ROM 811. As another configuration, the scan order storage ROM 811 may be controlled by a control device provided outside the controller 812-1.

The write clock signal RTV and the ROM address are externally supplied to the scan order storage ROM 811 at the time of initialization. The scan line address is input to the scan line address input AIN of the scan order storage ROM 811 according to the order corresponding to the scan drive method (interlace drive, for example). At the time of initialization, the scan line address is stored in the scan order storage ROM 811 according to the write clock signal RTV and the ROM address. The initialization is completed when the scan line addresses for N frames (N is an integer of one or more; N=1 in this example) are stored in the scan order storage ROM 811.

The details of writing of the scan line address into the scan order storage ROM 811 at the time of initialization are described below with reference to a timing chart shown in FIG. 4.

Figure 4:
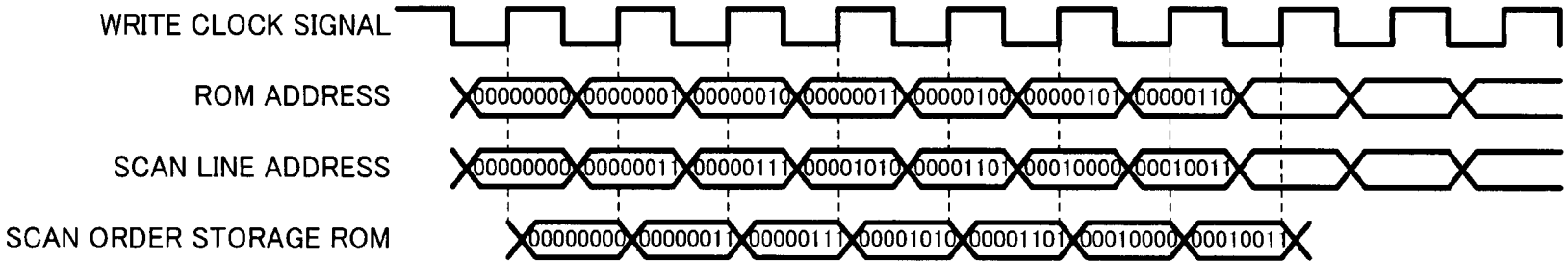
FIG. 4 is a timing chart when writing a scan line address into a scan order storage circuit.

FIG. 4 is a timing chart diagram when writing the scan line address into the scan order storage ROM 811. FIG. 4 shows the case where the display driver 300 performs an interlace drive (two-line skip).

The write clock signal RTV, the ROM address, and the scan line address are supplied to the scan order storage ROM 811. The ROM address and the scan line address are externally supplied to the scan order storage ROM 811 in synchronization with the write clock signal RTV. The scan line address is written into the scan order storage ROM 811 in synchronization with the rising edge of the write clock signal RTV.

In FIG. 4, the ROM address is sequentially incremented, but the scan line address is arbitrary. In FIG. 4, since the interlace drive (two-line skip) is performed, after a scan line address (00000000) is first written into the scan order storage ROM 811, a scan line address (00000011) is written into the scan order storage ROM 811. Then, a scan line address (00000111) is written.

As shown in FIG. 3, when power is supplied to the liquid crystal device 100 shown in FIG. 1, the scan line address stored in the scan order storage ROM 811 is supplied to the scan order storage RAM 812. In more detail, the scan order storage ROM 811 supplies the scan line address stored in the scan order storage ROM 811 to the line buffer 812-5 according to the control signal from the controller 812-1. The scan line address buffered in the line buffer 812-5 is supplied to the bitline driver 812-3. The controller 812-1 controls the wordline driver 812-2 and the bitline driver 812-3, and writes the scan line address into the memory element 812-4.

The above-described steps are repeated, whereby the scan line addresses for at least one frame among the scan line addresses stored in the scan order storage ROM 811 are supplied to the scan order storage RAM 812. Specifically, the scan line addresses for at least one frame are transferred to the scan order storage RAM 812 in the order corresponding to the scan drive method.

The address generation circuit 800 sequentially outputs the transferred scan line addresses stored in the scan order storage RAM 812 to the scan driver 400.

Figure 5:
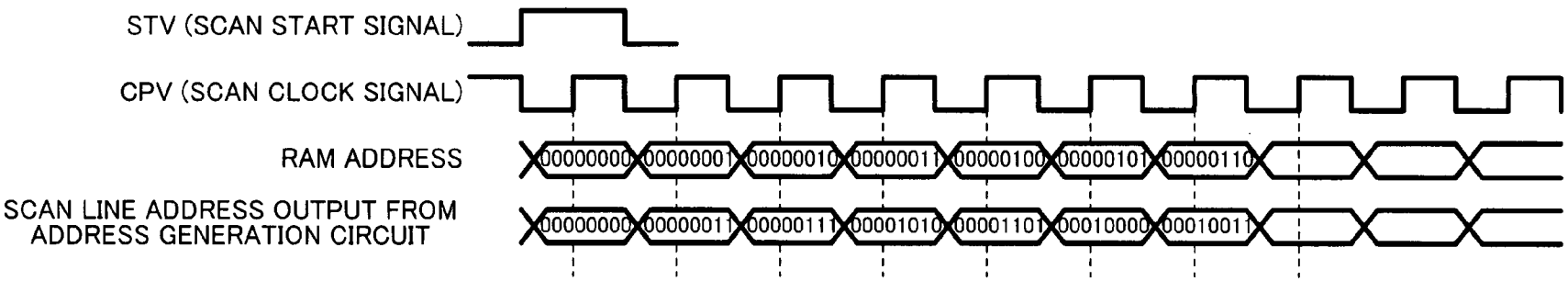
FIG. 5 is a timing chart when reading a scan line address from a scan order storage circuit.

The details when the address generation circuit 800 outputs the scan line address to the scan driver 400 are described with reference to FIG. 5. FIG. 5 is a timing chart showing the state in which the scan line address is read from the scan order storage RAM 812. The information stored in the scan order storage ROM 811 in which the scan line address is written as shown in FIG. 4 (two-line skip interlace drive) is transferred to the scan order storage RAM 812.

When the scan start signal STV is input to the address generation circuit 800, the address generation circuit 800 starts outputting the scan line address. In more detail, the controller 812-1 starts reading the scan line address in the memory element 812-4 in synchronization with the rising edge of the scan start signal STV input to the controller 812-1 in the scan order storage RAM 812 shown in FIG. 3. The reading of the scan line address is controlled in synchronization with the rising edge of the scan clock signal CPV input to the controller 812-1.

In FIG. 5, when the first scan clock signal CPV rises after the scan start signal STV has risen, the scan line address (00000000) stored at the RAM address (00000000) in the scan order storage RAM 812 is output from the scan line address output AQ of the address generation circuit 800.

In the scan order storage RAM 812, the controller 812-1 designates the RAM address for the wordline driver 812-2. The scan line address stored at the RAM address in the memory element 812-4 is supplied to the output buffer 812-6 by the bitline driver 812-3. The scan line address buffered in the output buffer 812-6 is output from the scan line address output AQ.

Since it suffices that the RAM address be sequentially incremented based on the rising edge of the scan start signal STV, the RAM address can be easily generated in the scan order storage RAM 812. Therefore, it is unnecessary to supply the RAM address from the outside.

When the second scan clock signal CPV rises, the scan line address (00000011) stored at the RAM address (00000001) in the scan order storage RAM 812 is output from the scan line address output AQ of the address generation circuit 800. The RAM addresses for at least one frame are read in the subsequent operation.

As described above, the address generation circuit 800 generates the scan line addresses in the order corresponding to the scan drive method (two-line skip interlace drive, for example) by sequentially incrementing the RAM address.

In the present embodiment, the address generation circuit 800 is configured to include the scan order storage ROM 811 and the scan order storage RAM 812. As another configuration, the address generation circuit 800 may not include the scan order storage RAM 812.

Figure 6:
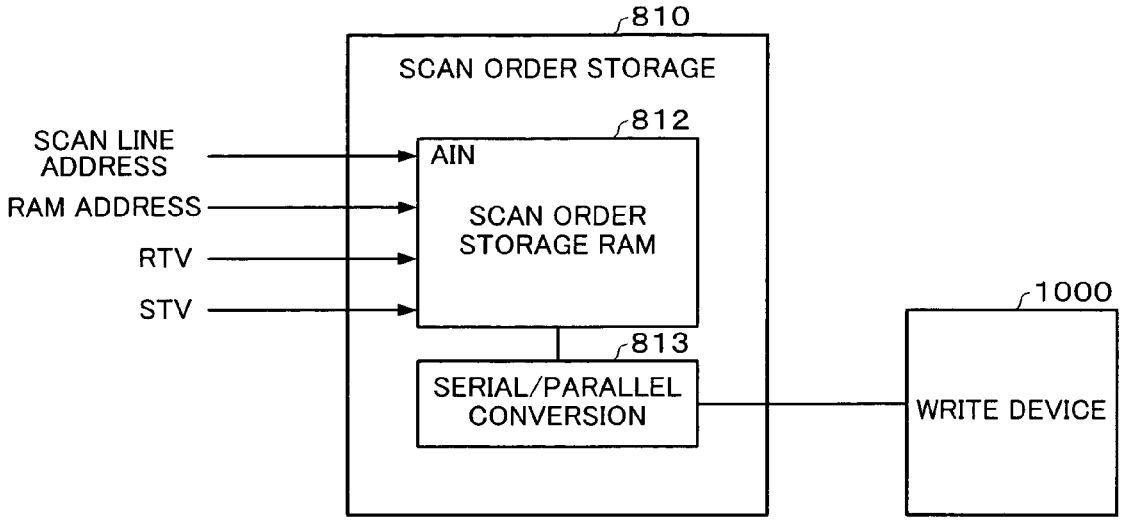
FIG. 6 is a block diagram of a scan order storage circuit according to a modification of the present invention.

As still another configuration, the scan order storage circuit 810 may be formed by the scan order storage RAM 812 and a serial/parallel conversion circuit 813, as shown in FIG. 6. In this case, the scan line address is written into the scan order storage RAM 812 from an external write device 1000. The scan line address is supplied from the write device 1000 as serial data. The serial data is then converted by the serial parallel conversion circuit 813, and the scan line address is written into the scan order storage RAM 812 at the timing shown in the timing chart shown in FIG. 4. In this case, the RAM address is input to the scan order memory RAM 812 instead of the ROM address shown in FIG. 4.

3. Scan Driver

Figure 7:
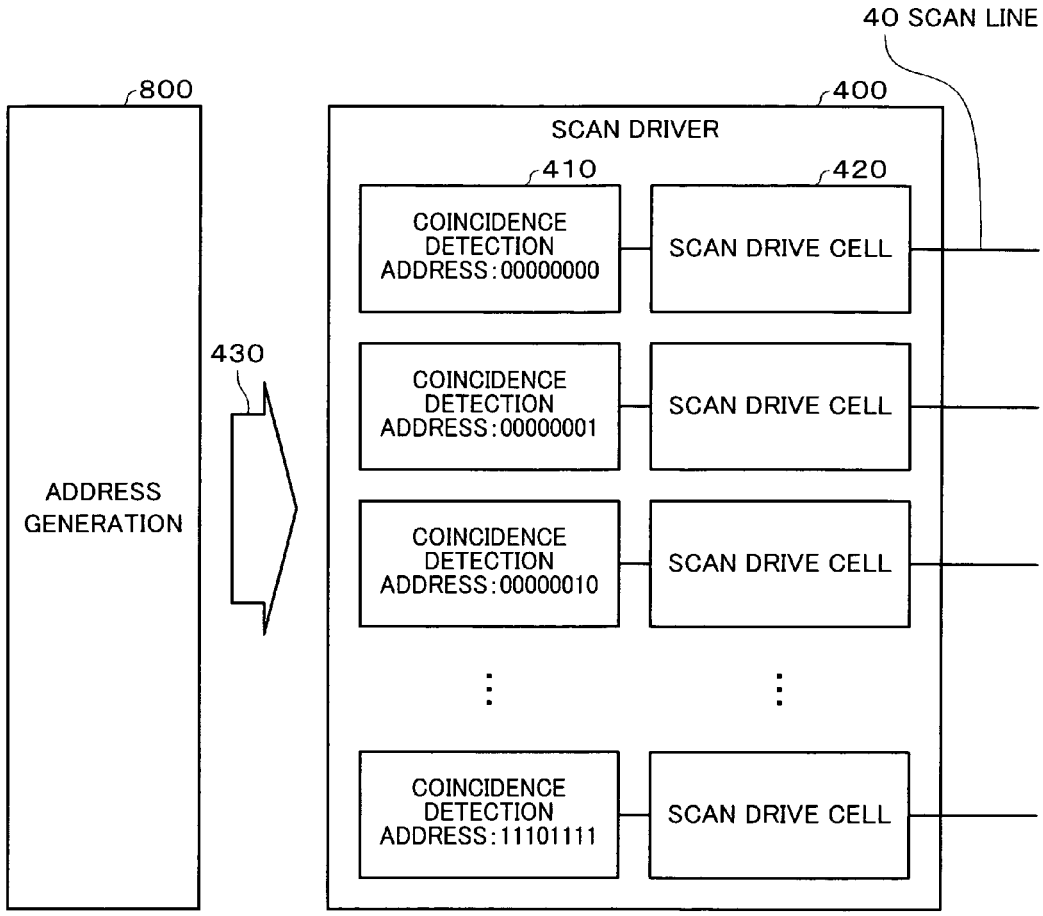
FIG. 7 is a diagram showing a configuration of a scan driver.

FIG. 7 shows a configuration of the scan driver 400. The scan driver 400 includes a plurality of coincidence detection circuits 410 and a plurality of scan drive cells 420. A scan line address (identification value) exclusive to each coincidence detection circuit 410 is assigned to each coincidence detection circuit 410. The coincidence detection circuit 410 is connected with the scan drive cell 420 which can drive at least one scan line 40, and the scan line 40 of the display panel 200 is connected with the scan drive cell 420.

The scan driver 400 is connected with the address generation circuit 800 through a scan line address bus 430. The scan line address output from the address generation circuit 800 is supplied to the scan driver 400 through the scan line address bus 430.

Figure 8:
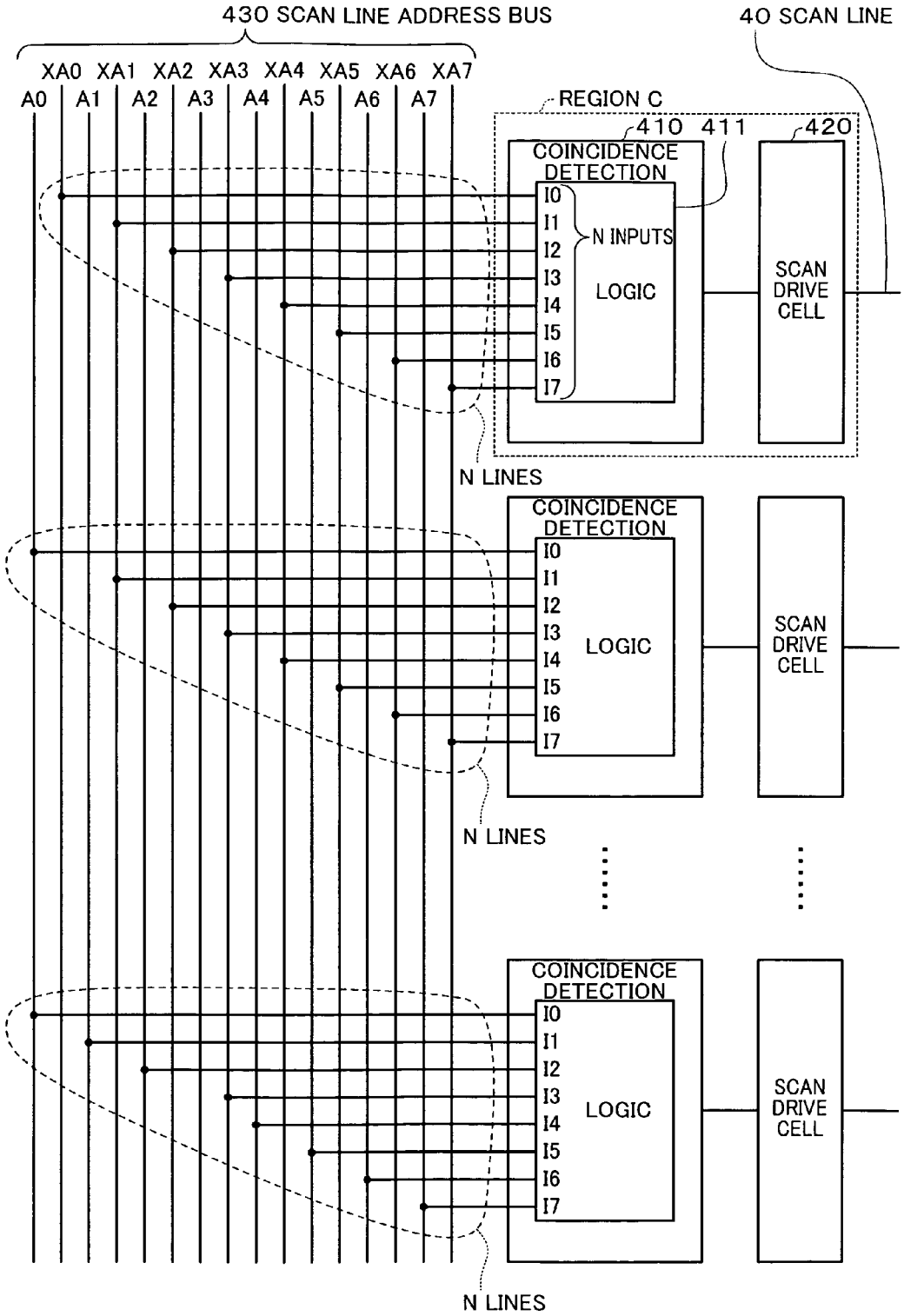
FIG. 8 is a diagram showing the connection between coincidence detection circuits and a scan line address bus.

The coincidence detection circuit 410 is described below. FIG. 8 is a diagram showing a configuration of the coincidence detection circuit 410 in the scan driver 400. The coincidence detection circuit 410 includes a logic circuit 411. The logic circuit 411 includes inputs I0 to I7 (N input in a broad sense). The scan line address bus 430 includes address signal lines A0 to A7 and XA0 to XA7. The address signal line XA0 shows a reversed value of the address signal line A0. The address signal lines XA1 to XA7 respectively show reversed values of the address signal lines A1 to A7. The connection combination of the inputs I0 to I7 of the logic circuit 411 in the coincidence detection circuit 410 with the address signal lines A0 to A7 and XA0 to XA7 of the scan line address bus 430 is exclusive to each coincidence detection circuit 410. Therefore, the difference in the connection pattern between each coincidence detection circuit 410 when connecting the address signal lines A0 to A7 and XA0 to XA7 in the scan line address bus 430 with the inputs I0 to I7 of the logic circuit 411 corresponds to the scan line address exclusively assigned to each coincidence detection circuit 410.

A region C shown in FIG. 8 enclosed by a dotted line is used to provide further detailed description. The logic circuit 411 is provided in the coincidence detection circuit 410 in the region C. The inputs I0 to I7 of the logic circuit 411 are connected with eight (N in a broad sense) address signal lines selected from among the address signal lines A1 to A7 and XA0 to XA7 in the scan line address bus 430. In more detail, the input I0 of the logic circuit 411 is connected with the address signal line XA0 in the scan line address bus 430, the input I1 of the logic circuit 411 is connected with the address signal line XA1 in the scan line address bus 430, the input I2 is connected with the address signal line XA2, and the input I3 is connected with the address signal line XA3. The input I4 of the logic circuit 411 is connected with the address signal line XA4 in the scan line address bus 430, the input I5 is connected with the address signal line XA5, the input I6 is connected with the address signal line XA6, and the input I7 is connected with the address signal line XA7. This connection combination is exclusive, and is not used for connection between other coincidence detection circuits 410 and the scan line address bus 430.

Specifically, in the case where 8-bit data "00000000" is supplied to the coincidence detection circuit 410 from the scan line address bus 430 as the address signal, an active signal (signal which ON-drives the scan line 40) is uniquely supplied to the scan drive cell 420 in the region C from the logic circuit 411 in the coincidence detection circuit 410. The signal line A0 goes active (signal at H level) when the most significant bit of the 8-bit data is "1", and the signal line A7 goes active when the least significant bit of the 8-bit data is "1". Specifically, 8-bit data "00000000" is data which causes the signal lines XA0 to XA7 to go active.

In the present embodiment, the scan line 40 is identified by assigning the exclusive scan line address to the coincidence detection circuit 410 connected with the scan drive cell 420. According to the present embodiment, in the case of driving an arbitrary scan line 40, it suffices to supply the corresponding scan line address to the scan line address bus 430. In the present embodiment, the scan line address bus 430 consists of 16 bits. However, the scan driver 400 can be applied to various display panels by appropriately setting the number of bits of the scan line address bus 430 corresponding to the number of scan lines 40.

The scan drive cell 420 is described below.

Figure 9:
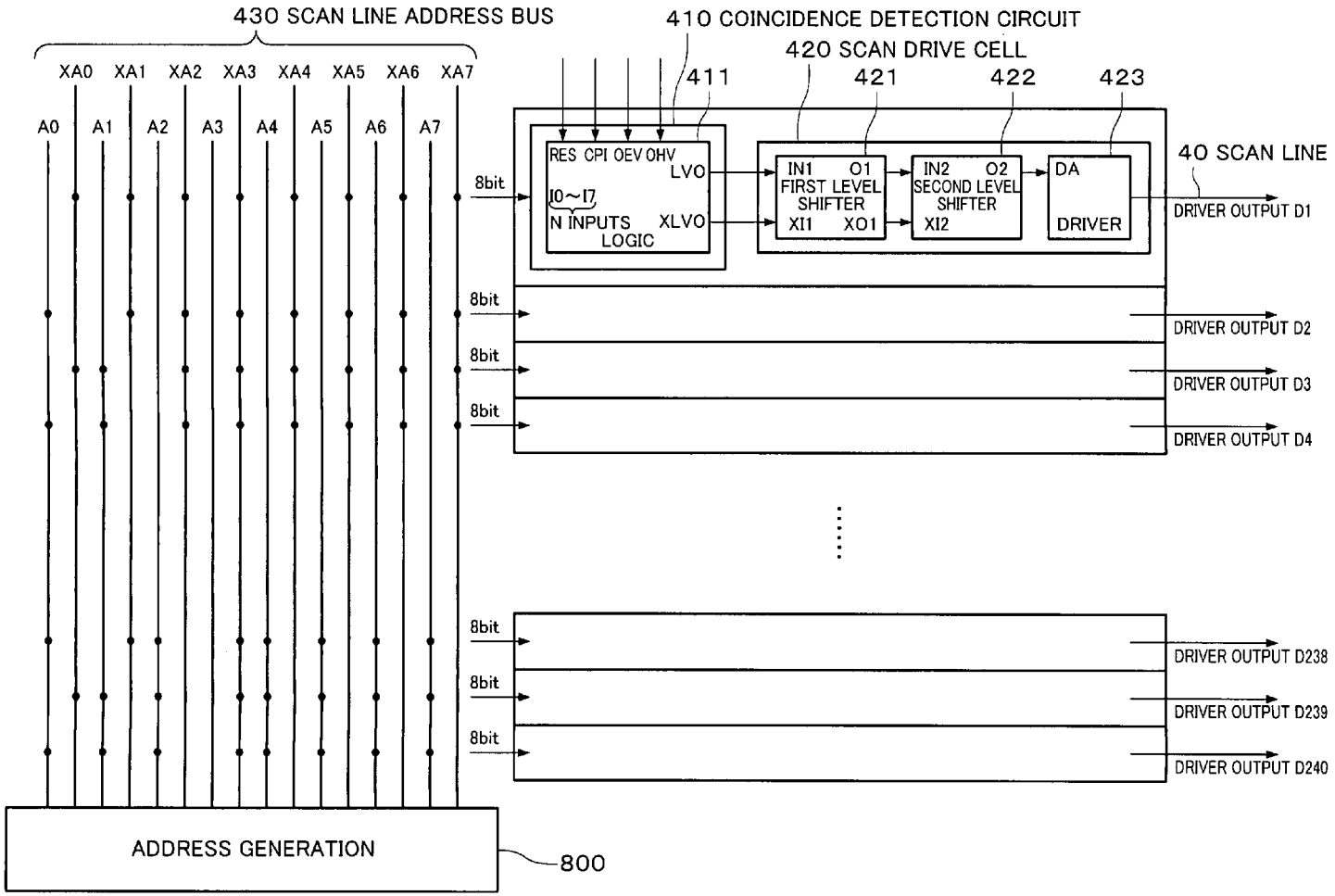
FIG. 9 is a diagram showing a configuration of a coincidence detection circuit and a scan drive cell.

FIG. 9 is a block diagram showing the logic circuit 411 and the scan drive cell 420. The logic circuit 411 (coincidence detection circuit 410) includes the inputs I0 to 17 corresponding to the outputs from the scan line address bus 430, a reset input RES, a scan clock input CPI, an output-enable-input OEV, and an output-fix-input OHV. When a signal at the "L" level is input to the reset input RES, data in a register in the logic circuit 411 is reset, and the coincidence detection circuit 410 OFF-drives (drives at non-active) the scan drive cell 420. A scan synchronization pulse is input to the scan clock input CPI. The coincidence detection circuit 410 always OFF-drives (drives at non-active) the scan drive cell 420 in a period in which a signal at the "L" level (non-active) is input to the output-enable-input OEV of the logic circuit 411. The coincidence detection circuit 410 always ON-drives (drives at active) the scan drive cell 420 in a period in which a signal at the "L" level (active) is input to the output-fix-input OHV of the logic circuit 411. Drive of the scan line 40 can be controlled without destroying the data retained in the register (flip-flop) in the logic circuit 411 by using at least one of the output-enable-input OEV and the output-fix-input OHV. The logic circuit 411 includes logic circuit outputs LVO and XLVO which output a drive signal to the scan drive cell 420. The logic circuit output LVO outputs either a signal which ON-drives (drives at active) the scan drive cell 420 or a signal which OFF-drives (drives at non-active) the scan drive cell 420. The logic circuit output XLVO outputs a signal generated by reversing the signal output from the logic circuit output LVO.

The scan drive cell 420 includes a first level shifter 421, a second level shifter 422, and a driver 423. The first level shifter 421 includes first level shifter inputs IN1 and XI1 and first level shifter outputs O1 and XO1. The logic circuit output LVO is connected with the first level shifter input IN1, and the logic circuit output XLVO is connected with the first level shifter input XI1.

The second level shifter 422 includes second level shifter inputs IN2 and XIN2 and second level shifter outputs O2 and XO2. The first level shifter output O1 is connected with the second level shifter input IN2, and the first level shifter output XO1 is connected with the second level shifter input XI2.

The driver 423 includes a driver input DA. The second level shifter output O2 is connected with the driver input DA of the driver 423. The scan line 40 is connected with the driver 423. The driver 423 drives (ON-drives or OFF-drives) the scan line 40 corresponding to the signal from the second level shifter output O2.

Figure 10:
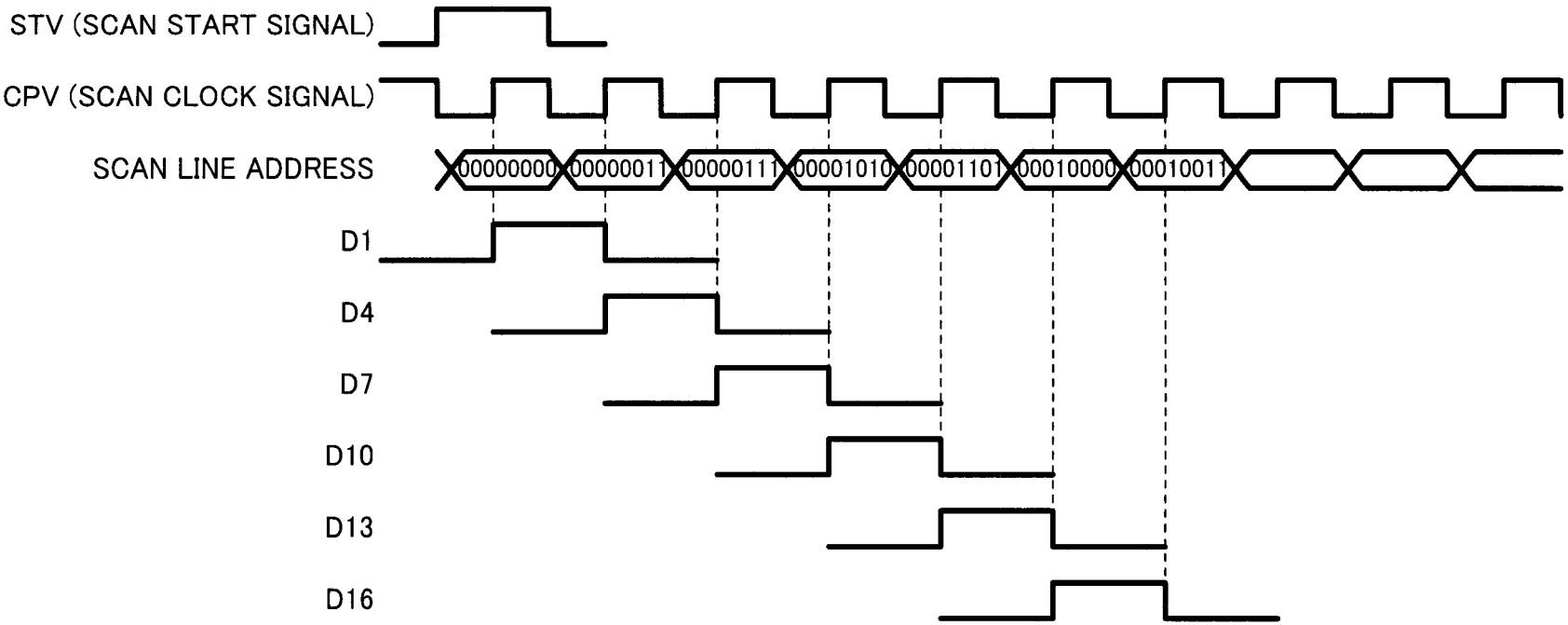
FIG. 10 is a timing chart when driving a scan line.

The scan control signal and a control method for the scan driver 400 using the scan control signal are described below using a timing chart shown in FIG. 10. The scan clock input CPI of the logic circuit 411 receives the scan clock signal CPV. Symbols D1 to D16 denote driver outputs. FIG. 10 shows a timing chart at the time of an interlace drive (two-line skip) as an example.

The scan drive cell 420 is driven by the corresponding coincidence detection circuit 410 in synchronization with the scan clock signal CPV. The scan line address is supplied to the scan line address bus 430 by the address generation circuit 800. The coincidence detection circuit 410 detects coincidence with the scan line address (address data) supplied to the scan line address bus 430. The coincidence detection circuit 410 which coincides with the scan line address (address data) drives the corresponding scan drive cell 420 in synchronization with the scan clock signal CPV.

For example, when an 8-bit address "00000000" is supplied to the scan line address bus 430 as the scan line address (address data), the corresponding scan drive cell 420 select-drives (ON-drives) the driver output D1 in synchronization with the rising edge of the scan clock signal CPV. The driver outputs D1 to D240 are select-driven (ON-driven) in the same manner as described above corresponding to the scan line addresses (address data) in the scan line address bus 430.

An escape address is used as a stop mark after driving all the scan lines 40. An address which is not assigned to the coincidence detection circuits 410 is used as the escape address. It is possible to prevent the scan drive cells 420 from being select-driven by supplying an 8-bit address "11111111", which is not assigned to the coincidence detection circuits 410, to the scan line address bus 430, for example.

In the present embodiment, the escape address is stored in the scan order storage circuit 810. In more detail, the scan line addresses for one frame are continuously stored in the scan order storage circuit 810, and the escape address is stored at least in front of or behind the scan line addresses for one frame.

The above-described example illustrates an interlace drive (two-line skip). However, the present embodiment can easily deal with various drive methods. In order to deal with a desired drive method, the scan line addresses may be written into the scan order storage circuit 810 in the address generation circuit 800 in the order corresponding to the desired drive method. This makes it possible to deal with a comb-tooth drive or a normal drive (line sequential drive), for example.

Three types of operations (normal operation mode, normally ON drive, and normally OFF drive) of the logic circuit 411 in the coincidence detection circuit 410 are described below.

Figure 11:
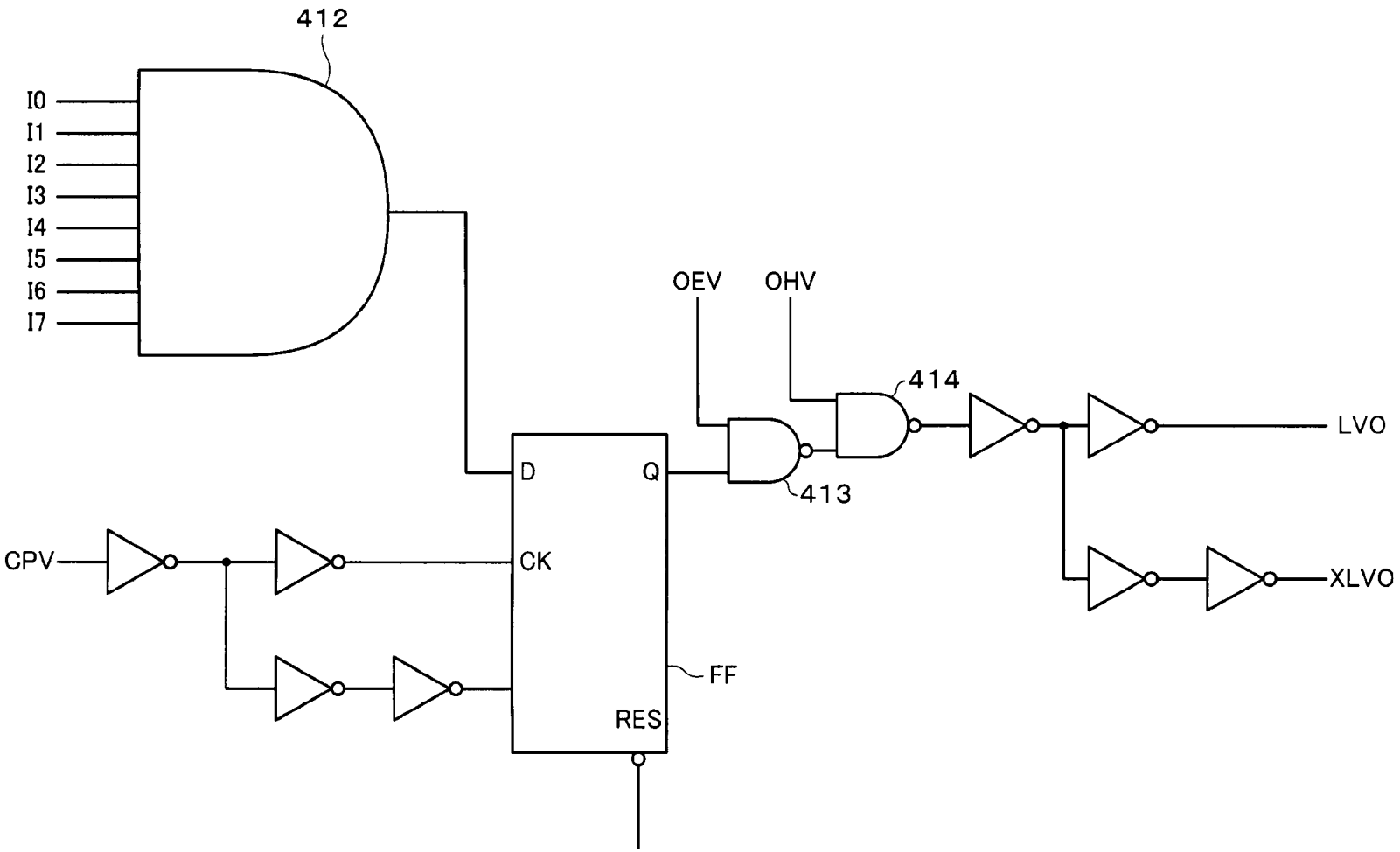
FIG. 11 is a circuit diagram of a logic circuit.

FIG. 11 is a circuit diagram of the logic circuit 411. A numeral 412 denotes an eight-input AND circuit. The inputs of the eight-input AND circuit 412 are the inputs I0 to I7 of the logic circuit 411. Numerals 413 and 414 denote NAND circuits. A symbol FF denotes a flip-flop circuit.

In the normal operation mode, a signal at the "H" level is input to the output-enable-input OEV of the NAND circuit 413 and a signal at the "H" level is input to the output-fix-input OHV of the NAND circuit 414. For example, when signals at the "H" level are input to the inputs I0 to I7 and the output of the eight-input AND circuit 412 is at the "H" level, a signal at the "H" level is input to a D terminal of the flip-flop FF. The flip-flop FF latches the data (signal at "H" level) input to the D terminal in synchronization with the rising edge of the scan clock signal CPV input to a CK terminal of the flip-flop FF. A Q terminal is set at the "H" level in a period in which the flip-flop FF latches the data (signal at "H" level). Since a signal at the "H" level is input to the output-enable-input OEV of the NAND circuit 413 and a signal at the "H" level is input to the output-fix-input OHV of the NAND circuit 414, a signal at the "H" level is output from the logic circuit output LVO of the logic circuit 411. A signal at the "L" level generated by reversing the signal output from the logic circuit output LVO is output from the logic circuit output XLVO.

When the output of the eight-input AND circuit 412 is at the "L" level, data for a signal at the "L" level is latched by the flip-flop FF, whereby a signal at the "L" level is output from the logic circuit output LVO.

A signal at the "L" level is input to the output-fix-input OHV during a normally ON drive (when signal at "H" level is always output from the output LVO). Since the output of the NAND circuit 414 is at the "H" level independent of the output of the NAND circuit 413, the logic circuit output LVO is at the "H" level.

A signal at the "H" level is input to the output-fix-input OHV and a signal at the "L" level is input to the output-enable-input OEV during a normally OFF drive (when signal at "L" level is always output from the output LVO). Since the output of the NAND circuit 413 is at the "H" level independent of the output of the Q terminal of the flip-flop FF, the output of the NAND circuit 414 is at the "L" level and the logic circuit output LVO is at the "L" level.

Specifically, the operation (normal operation mode, normally ON drive, and normally OFF drive) can be switched by controlling the signals supplied to the output-enable-input OEV and the output-fix-input OHV. When a signal at the "L" level is input to the output-fix-input OHV, the operation becomes a normally OFF drive (signal at "L" level is always output from the output LVO) independent of the signal input to the output-enable-input OEV.

The first level shifter 421 in the scan drive cell 420 is described below.

Figure 12:
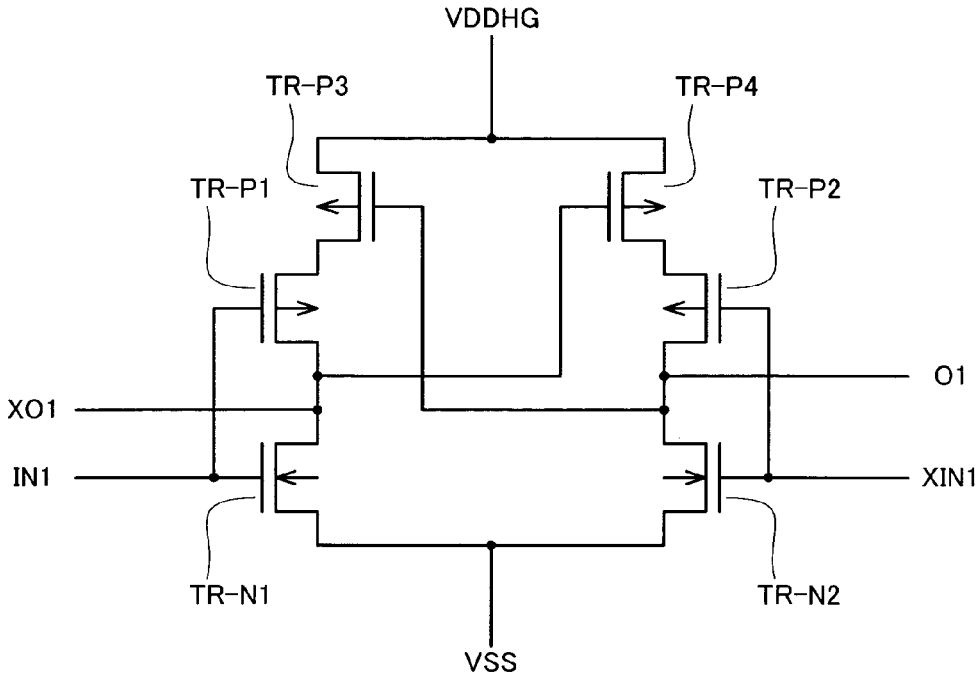
FIG. 12 is a circuit diagram of a first level shifter in a scan drive cell.

FIG. 12 is a circuit diagram of the first level shifter 421. The first level shifter 421 includes N-type transistors TR-N1 and TR-N2 (switching devices in a broad sense) and P-type transistors TR-P1 to TR-P4 (switching devices in a broad sense). The "H" level or "L" level is exclusively input to the first level shifter inputs IN1 and XIN1. For example, when a signal at the "H" level is input to the first level shifter input IN1, a signal at the "L" level is input to the first level shifter input XIN1. The first level shifter outputs O1 and XO1 exclusively output the "H" level or "L" level to the second level shifter 422. For example, when a signal at the "H" level is output from the first level shifter output O1, a signal at the "L" level is output from the first level shifter output XO1.

In the case where the scan line address (address data) supplied to the scan line address bus 430 from the address generation circuit 800 coincides with the address assigned to the coincidence detection circuit 410, the output of the logic circuit output LVO in the coincidence detection circuit 410 is set at the "H" level. A signal at the "H" level is input to the first level shifter input IN1 of the first level shifter 421, and the output (signal at "L" level in this case) of the logic circuit output XLVO is input to the first level shifter input XIN1.

In this case, the N-type transistor TR-N1 is turned ON, and the P-type transistor TR-P1 is turned OFF. This causes a voltage VSS to be output from the first level shifter output XO1. The N-type transistor TR-N2 is turned OFF, and the P-type transistor TR-P2 is turned ON. Since the voltage VSS is input to a gate input of the P-type transistor TR-P4, the P-type transistor TR-P4 is turned ON. As a result, a voltage VDDHG is output to the first level shifter output O1.

When a signal at the "L" level is input to the first level shifter input IN1 and a signal at the "H" level is input to the first level shifter input XIN1, the P-type transistor TR-P1, the N-type transistor TR-N2, and the P-type transistor TR-P3 are turned ON. The N-type transistor TR-N1, the P-type transistor TR-P2, and the P-type transistor TR-P4 are turned OFF. Therefore, the voltage VDDHG is output from the first level shifter output XO1, and the voltage VSS is output from the first level shifter output O1.

The signal at the "H" level or the "L" level output to the first level shifter 421 is level-shifted to the signal level of the voltage VDDHG or the voltage VSS.

The second level shifter 422 is described below.

Figure 13:
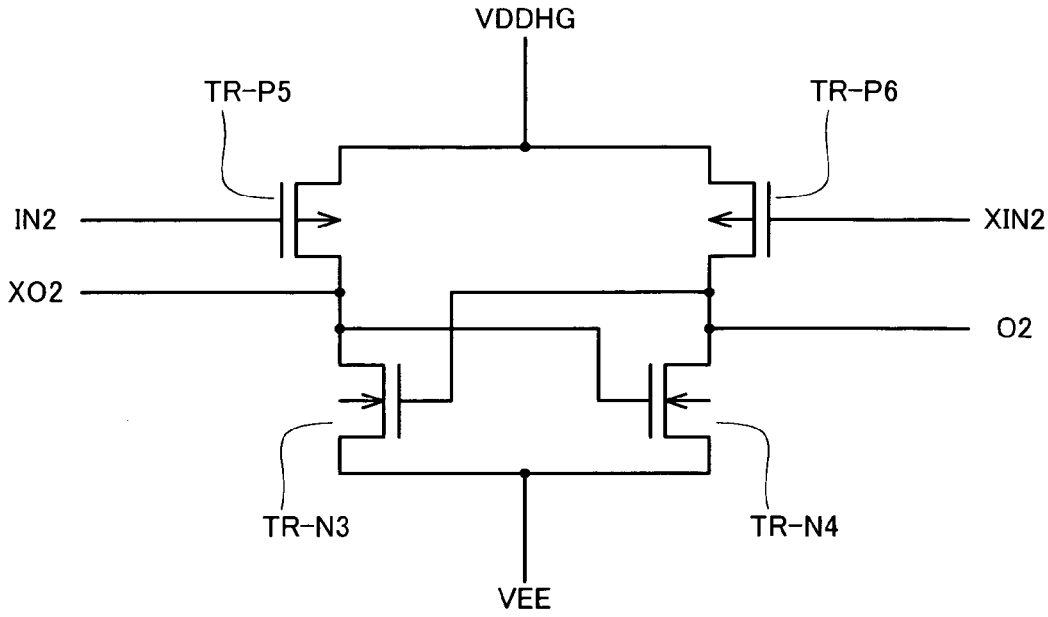
FIG. 13 is a circuit diagram of a second level shifter in a scan drive cell.

FIG. 13 is a circuit diagram of the second level shifter 422. The second level shifter 422 includes N-type transistors TR-N3 and TR-N4 and P-type transistors TR-P5 and TR-P6. The "H" level or the "L" level is exclusively input to the second level shifter inputs IN2 and XIN2. For example, when a signal at the "H" level is input to the second level shifter input IN2, a signal at the "L" level is input to the second level shifter input XIN2. The second level shifter outputs O2 and XO2 exclusively output the "H" level or the "L" level. For example, when a signal at the "H" level is output from the second level shifter output O2, a signal at the "L" level is output from the second level shifter output XO2.

When a signal at the voltage VDDHG is input to the second level shifter input IN2 of the second level shifter 422, a signal at the voltage VSS is exclusively input to the second level shifter input XIN2. In this case, the P-type transistor TR-P5 is turned OFF, and the P-type transistor TR-P6 is turned ON. This causes a signal at the voltage VDDHG to be output from the second level shifter output O2.

A signal at the voltage VDDHG is input to a gate of the N-type transistor TR-N3, whereby the N-type transistor TR-N3 is turned ON. This causes a voltage VEE to be output from the second level shifter output XO2.

When a signal at the voltage VDDHG is input to the second level shifter input XIN2 and a signal at the voltage VSS is input to the second level shifter input IN2, the P-type transistor TR-P5 is turned ON, and the P-type transistor TR-P6 is turned OFF. This causes a signal at the voltage VDDHG to be output from the second level shifter output XO2. A signal at the voltage VDDHG is input to a gate of the N-type transistor TR-N4, whereby the N-type transistor TR-N4 is turned ON. This causes a signal at the voltage VEE to be output from the second level shifter output O2.

Specifically, the signal at the voltage VSS input to the second level shifter input IN2 or XIN2 is level-shifted to the signal at the voltage VEE, and is output from the second level shifter output O2 or XO2.

The driver 423 is described below.

Figure 14:
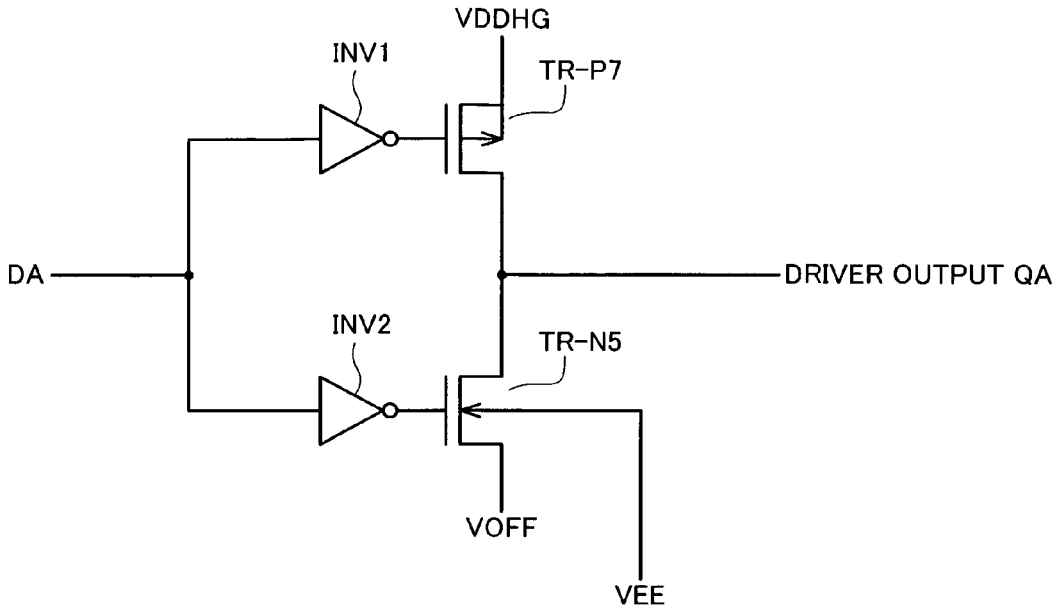
FIG. 14 is a circuit diagram of a driver in a scan drive cell.

FIG. 14 is a circuit diagram of the driver 423. The driver 423 includes an N-type transistor TR-N5 and a P-type transistor TR-P7. The signal output from the second level shifter output O2 is input to a driver input DA. The voltage VDDHG is supplied to a source (or drain) of the P-type transistor TR-P7, and the substrate potential is set at the voltage VDDHG A voltage VOFF is supplied to a source of the N-type transistor TR-N5, and the substrate potential is set at the voltage VEE.

When a signal at the voltage VDDHG is input to the driver input DA from the second level shifter output O2, the signal is reversed by an inverter INV1, whereby the P-type transistor TR-P7 is turned ON. This causes a signal at the voltage VDDHG to be output from the driver output QA between the source and drain of the P-type transistor TR-P7. The N-type transistor TR-N5 remains in the OFF state. In this case, the signal at the voltage VDDHG input to the driver input DA is reversed by an inverter INV2, and input to the gate of the N-type transistor TR-N5. However, since the substrate potential of the N-type transistor TR-N5 is set at VEE, the gate threshold of the N-type transistor TR-N5 is high, whereby the N-type transistor TR-N5 can be securely turned OFF.

When a signal at the voltage VEE is input to the driver input DA from the second level shifter output O2, the signal is reversed by the inverter INV2, whereby the N-type transistor TR-N5 is turned ON. This causes a signal at the voltage VOFF to be output from the driver output QA between the source and drain of the N-type transistor TR-N5. The P-type transistor TR-P7 remains in the OFF state.

The scan driver 400 is operated as described above when driving the scan line 40 corresponding to the scan line address (address data) supplied to the scan line address bus 430 from the address generation circuit 800.

4. Effect

When supplying data from the outside through an interface, a specific amount of electric power is generally consumed each time the data is supplied. The specific amount of electric power contains unnecessary electric power consumed by using the interface in comparison with the case where the data is supplied inside the circuit. This power consumption cannot be disregarded if supply is increased.

The display driver 300 in the present embodiment is configured to include the address generation circuit 800. Therefore, the address generation circuit 800 can directly supply the scan line address to the scan driver 400 without using a complicated interface. Since the number of scan lines 40 is increased in the case of driving a high-definition panel, the number the scan line addresses as supplied per second is increased. Therefore, the present embodiment which can supply the scan line addresses with low power consumption is effective.

Moreover, processing required for an external control device is reduced by using the present embodiment, since the address generation circuit generates the scan line address. Therefore, a display device with an extremely flexible design specification for mounting on a small instrument such as a portable instrument can be provided.

It is possible to easily deal with various display panels and scan line drive methods by using the present embodiment.

Figure 15:
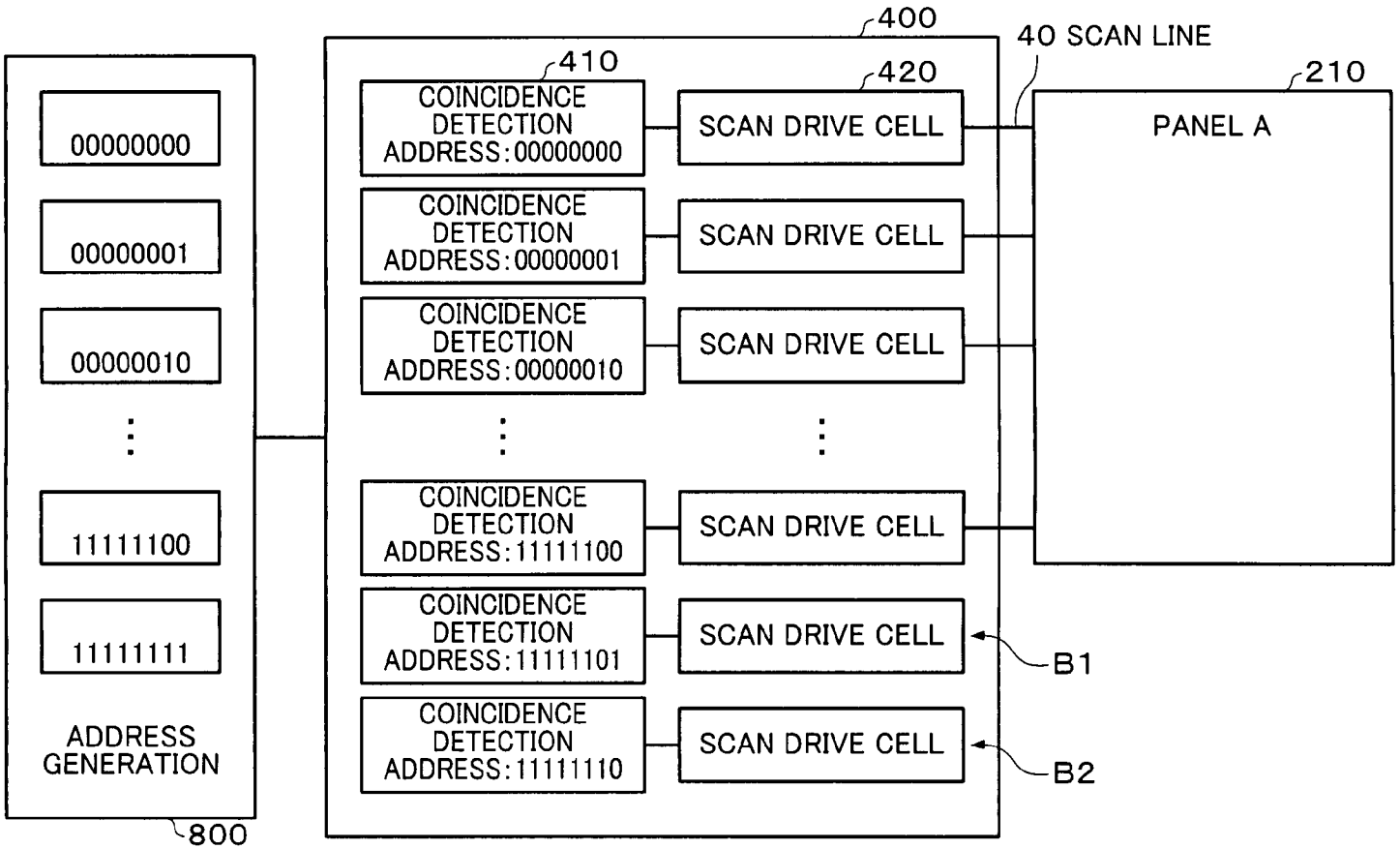
FIG. 15 is a diagram showing connection relationship of coincidence detection circuits, scan drive cells, and a panel A.

FIG. 15 is a diagram showing the scan driver 400 which drives a display panel 210 (hereinafter called "panel A"). The scan driver 400 shown in FIG. 15 includes 255 coincidence detection circuits 410 and 255 scan drive cells 420. The range of 8-bit addresses "00000000" to "11111110" is assigned to the coincidence detection circuits 410 as the scan line addresses. In FIG. 15, the scan drive cell 420 connected with the coincidence detection circuit 410 to which the scan line address "11111101" is assigned (B1 in FIG. 15) and the scan drive cell 420 connected with the coincidence detection circuit 410 to which the scan line address "11111110" is assigned (B2 in FIG. 15) are not connected with the panel A.

Specifically, the number of scan lines 40 provided in the panel A is smaller than the number of scan drive cells 420 provided in the scan driver 400. However, since the present embodiment uses the escape address (address other than the addresses assigned to the scan drive cells, or address which is not assigned to the scan drive cells) during drive, the panel A can be driven without changing the circuit configuration of the scan driver 400. The address generation circuit 800 supplies "11111100", which is the final address connected with the panel A, to the scan line address bus 430, and then supplies the escape address ("11111111", for example) to the scan line address bus 430. This allows the scan driver 400 in the present embodiment to drive the panel A.

Figure 16:
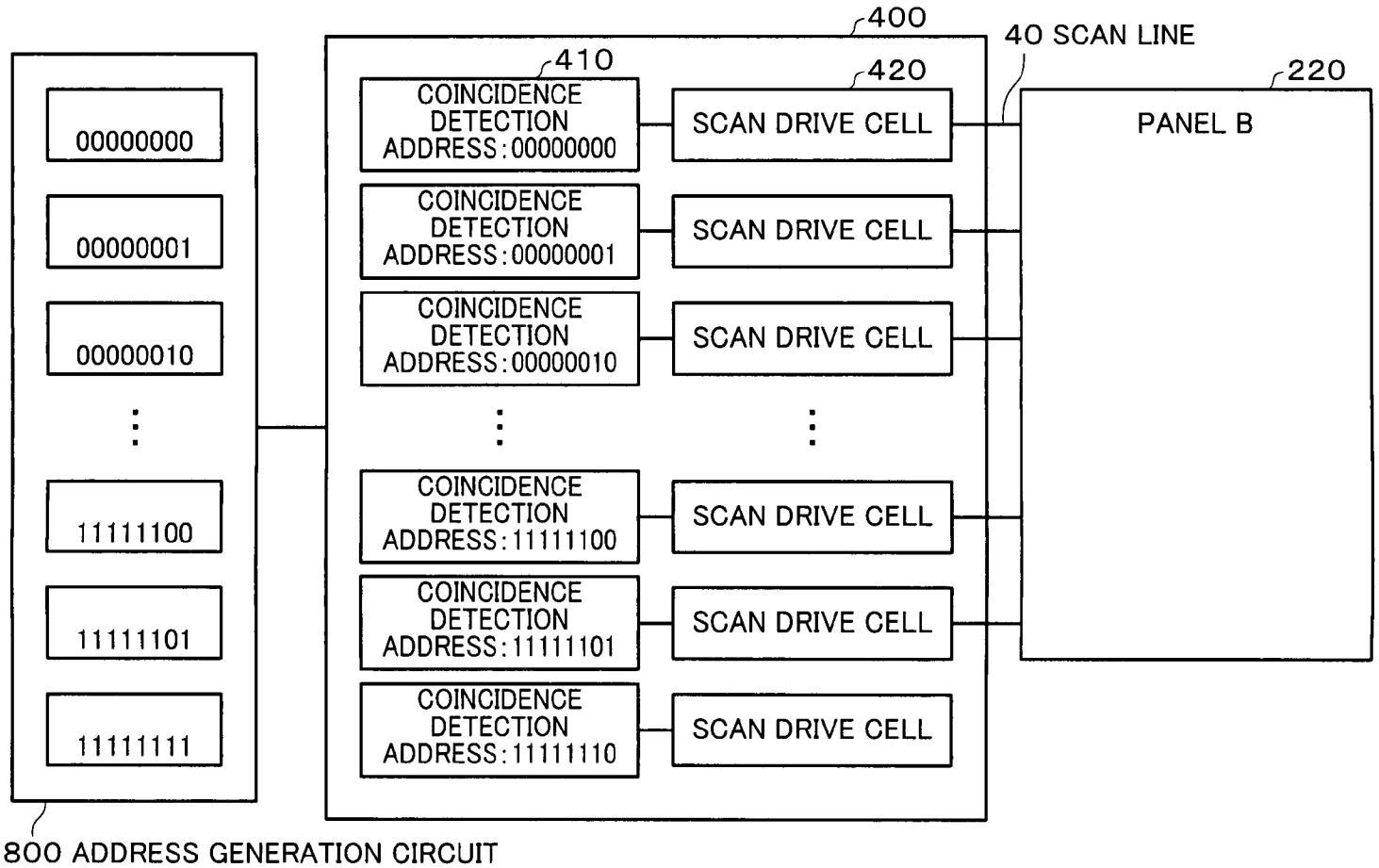
FIG. 16 is a diagram showing connection relationship of coincidence detection circuits, scan drive cells, and a panel B.

FIG. 16 is a diagram showing the scan driver 400 which drives a display panel 220 (hereinafter called "panel B"). In this case, the address generation circuit 800 supplies "11111101", which is the final address connected with the panel B, to the scan line address bus 430, and then supplies the escape address ("11111111", for example) to the scan line address bus 430. This allows the scan driver 400 in the present embodiment to drive the panel B.

The scan driver 400 can be utilized for various display panels by allowing the address generation circuit 800 to supply the escape address to the scan line address bus 430 as described above.

Figure 17:
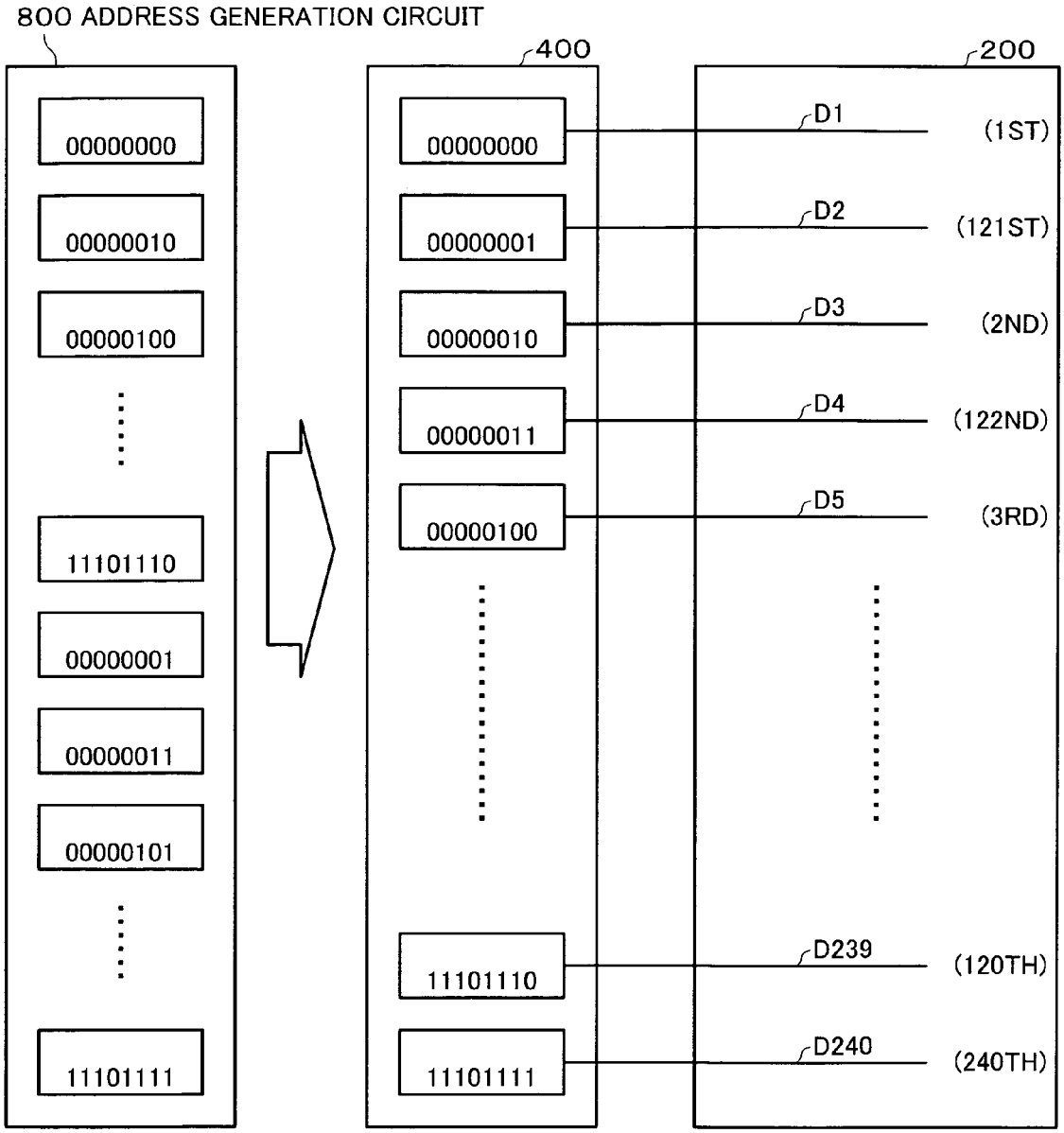
FIG. 17 is a diagram showing an interlace drive (one-line skip).

FIG. 17 is illustrative of an interlace drive (one-line skip). In the case of an interlace drive (one-line skip), the address generation circuit 800 generates the scan line addresses in the order of (00000000), (00000010), (00000100), . . . , (11101110), (00000001), (00000011), (00000101), . . . , (11101111) as shown in FIG. 17. When the scan line addresses generated in this order are supplied to the scan driver 400, the signals which drive the scan lines 40 are output from the driver outputs D1 to D240 by the coincidence detection circuits 410 in the order shown in FIG. 17 (driver output D1, driver output D3, driver output D5, . . . , driver output D239, driver output D2, driver output D4, . . . , driver output D240). This enables the display driver 300 to perform an interlace drive (one-line skip).

Figure 18:
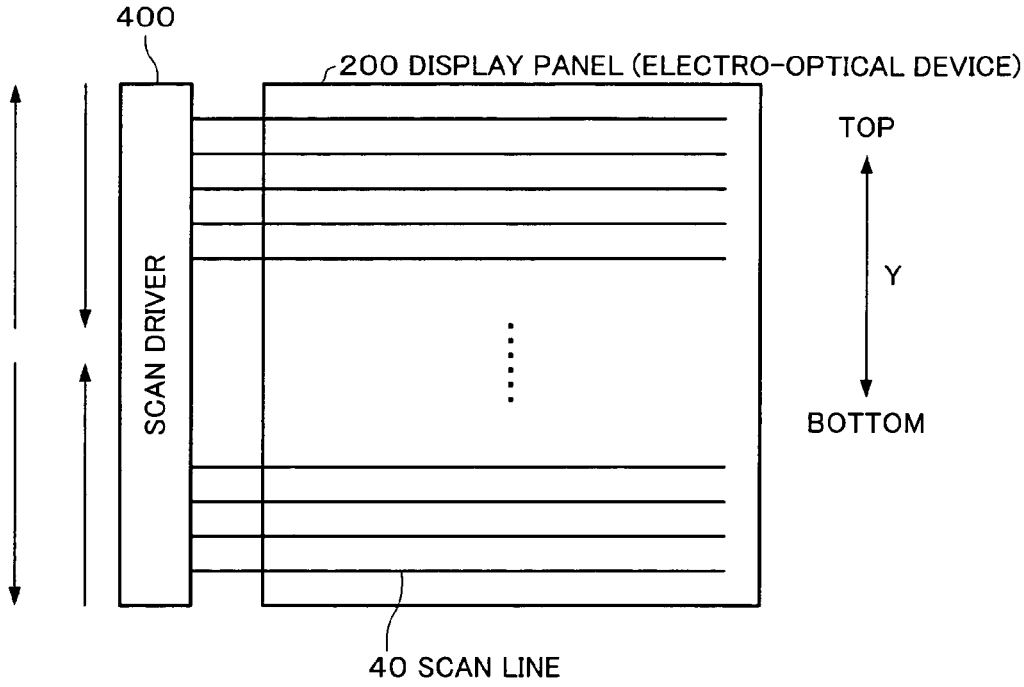
FIG. 18 is a diagram showing a comb-tooth drive.

FIG. 18 is illustrative of a comb-tooth drive. In the normal drive, the scan lines 40 are sequentially driven from the top to the bottom along the column direction Y shown in FIG. 18. In a comb-tooth drive, the scan lines 40 are simultaneously ON-driven toward the center from each end. Specifically, the uppermost scan line 40 in the column direction Y is ON-driven, and the lowermost scan line 40 in the column direction Y is ON-driven. The scan lines 40 are then sequentially ON-driven toward the center from each end. The comb-tooth drive method also includes the case where the scan lines 40 are ON-driven from the center toward each end along the column direction Y.

In the present embodiment, since the scan line address is assigned to each scan line 40, the scan addresses may be stored in the scan order storage circuit 810 in the address generation circuit 800 in the order of the scan line addresses to be driven. In the case of a comb-tooth drive in which the scan lines 40 are ON-driven toward the center from each end along the column direction Y, the uppermost scan line address in the column direction Y and the lowermost scan line address in the column direction Y are written into the scan order storage circuit 810. The scan line addresses are then written into the scan order storage circuit 810 toward the center from each end. This makes it possible to deal with a comb-tooth drive.

Conventionally, it is necessary to separately provide a logic circuit for an interlace drive or a comb-tooth drive to the scan driver 400. Moreover, it is necessary to form a complicated logic circuit in order to deal with all of the normal drive, interlace drive, and comb-tooth drive.

In the present embodiment, since various drive methods can be dealt with without using such a complicated circuit, the manufacturing cost can be reduced and versatility can be increased.

The present invention is not limited to the present embodiment. Various modifications and variations are possible within the spirit and scope of the present invention. For example, the configuration of the coincidence detection circuit is not limited to the configuration shown in FIG. 11. A circuit configuration logically equivalent to the configuration shown in FIG. 11 may be employed. The configuration of the scan drive cell is not limited to the configuration described with reference to FIGS. 7 to 9. For example, the number of level shifters may be one.

The present embodiment illustrates an example in which the present invention is applied to an active matrix liquid crystal device. However, the present invention may be applied to a simple matrix liquid crystal device or the like. The present invention may also be applied to an electro-optical device (organic EL device, for example) other than a liquid crystal device.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A drive method for driving at least a plurality of scan lines of a display panel by using a plurality of scan drive cells, the display panel including the scan lines, a plurality of data lines, and a plurality of pixels, the drive method comprising:

storing scan line addresses corresponding to a scan order in a scan order storage circuit of an address generation circuit;

comparing an address exclusively assigned to each of the plurality of scan drive cells with one of the scan line addresses output from the address generation circuit, and outputting a comparison result to each of the plurality of scan drive cells;

driving each of the plurality of scan lines by corresponding one of the plurality of scan drive cells;

comparing each of the scan line addresses supplied from the address generation circuit with the address exclusively assigned to one of the plurality of scan drive cells by one of a plurality of coincidence detection circuits;

ON-driving each of the plurality of scan drive cells by one of the plurality of coincidence detection circuits in a period in which an active signal is input to an output-fix-input of each of the plurality of coincidence detection circuits, each of the plurality of scan drive cells being connected with one of the plurality of coincidence detection circuits; and OFF-driving each of the plurality of scan drive cells by one of the plurality of coincidence detection circuits in a period in which a non-active signal is input to an output-enable-input of each of the plurality of coincidence detection circuits.

2. A drive method for driving at least a plurality of scan lines of a display panel by using a plurality of scan drive cells, the display panel including the scan lines, a plurality of data lines, and a plurality of pixels, the drive method comprising:

storing scan line addresses corresponding to a scan order in a scan order storage circuit of an address generation circuit;

comparing an address exclusively assigned to each of the plurality of scan drive cells with one of the scan line addresses output from the address generation circuit, and outputting a comparison result to each of the plurality of scan drive cells;

driving each of the plurality of scan lines by corresponding one of the plurality of scan drive cells; and comparing each of the scan line addresses supplied from the address generation circuit with the address exclusively assigned to one of the plurality of scan drive cells by one of a plurality of coincidence detection circuits, when one of the plurality of coincidence detection circuits determines that one of the scan line addresses supplied from the address generation circuit coincides with the address exclusively assigned to one of the plurality of scan drive cells, the one of the plurality of scan drive cells driving corresponding one of the scan lines.

3. A drive method for driving at least a plurality of scan lines of a display panel by using a plurality of scan drive cells, the display panel including the scan lines, a plurality of data lines, and a plurality of pixels, the drive method comprising:

storing scan line addresses corresponding to a scan order in a scan order storage circuit of an address generation circuit;

comparing an address exclusively assigned to each of the plurality of scan drive cells with one of the scan line addresses output from the address generation circuit, and outputting a comparison result to each of the plurality of scan drive cells; and driving each of the plurality of scan lines by corresponding one of the plurality of scan drive cells; and outputting from the address generation circuit an address other than the address assigned to each of the plurality of scan drive cells to each of the plurality of coincidence detection circuits, when none of the plurality of scan lines are selected.

4. A display driver which drives at least a plurality of scan lines of a display panel, the display panel including the scan lines, a plurality of data lines, and a plurality of pixels, the display driver comprising:

an address generation circuit; a plurality of scan drive cells; and a plurality of coincidence detection circuits, the address generation circuit including a scan order storage circuit in which scan line addresses are stored corresponding to a scan order, the address generation circuit outputting the scan line addresses stored in the scan order storage circuit, each of the plurality of coincidence detection circuits being connected with one of the plurality of scan drive cells, each of the plurality of coincidence detection circuits outputting to the one of the plurality of scan drive cells a result of comparison between an address exclusively assigned to each of the plurality of scan drive cells and one of the scan line addresses output from the address generation circuit, and each of the plurality of scan drive cells driving one of the plurality of scan lines.

5. The display driver as defined in claim 4, comprising a scan line address bus for supplying the scan line addresses.

6. The display driver as defined in claim 5, the scan line address bus including a plurality of address signal lines, and a combination of connecting each of the plurality of coincidence detection circuits with the address signal lines differing between each of the plurality of coincidence detection circuits.

7. The display driver as defined in claim 6, at least an N address signal line (N is an integer equal to or greater than one) among the plurality of address signal lines being connected with at least one of the plurality of coincidence detection circuits, and each of the plurality of coincidence detection circuits including a logic circuit having at least an N input.

8. The display driver as defined in claim 4, when one of the plurality of coincidence detection circuits determines that one of the scan line addresses supplied from the address generation circuit coincides with the address exclusively assigned to one of the plurality of scan drive cells, the one of the plurality of scan drive cells driving corresponding one of the plurality of scan lines.

9. The display driver as defined in claim 4, when none of the plurality of scan lines are selected, the address generation circuit outputting to each of the plurality of coincidence detection circuits an address other than the address assigned to each of the plurality of scan drive cells.

10. The display driver as defined in claim 4, the address generation circuit including a counter, and the scan order storage circuit sequentially outputting the stored scan line addresses based on the counter.

11. The display driver as defined in claim 4, the scan order storage circuit including a scan order storage ROM in which the scan line addresses are stored corresponding to a scan order, and the address generation circuit outputting the scan line address stored in the scan order storage ROM.

12. The display driver as defined in claim 4, the scan order storage circuit including a scan order storage RAM in which the scan line addresses are stored corresponding to a scan order, and the address generation circuit outputting the scan line address stored in the scan order storage RAM.

13. The display driver as defined in claim 4, the scan order storage circuit including a scan order storage RAM and a scan order storage ROM in which the scan line addresses are stored corresponding to a scan order, information stored in the scan order storage ROM being supplied to the scan order storage RAM at the time of power-on, and the address generation circuit outputting the information which has been supplied to the scan order storage RAM.

14. The display driver as defined in claim 4, the scan line addresses being sequentially written into the scan order storage circuit in an ascending order or a descending order, and after a last scan line address among the scan line addresses is written into the scan order storage circuit, an address other than the address assigned to each of the plurality of scan drive cells being written into the scan order storage circuit.

15. The display driver as defined in claim 4, each of the plurality of coincidence detection circuits including at least one of an output-enable-input and an output-fix-input, each of the plurality of coincidence detection circuits ON-driving corresponding one of the plurality of scan drive cells in a period in which an active signal is input to the output-fix-input, and wherein each of the plurality of coincidence detection circuits OFF-driving corresponding one of the plurality of scan drive cells in a period in which a non-active signal is input to the output-enable-input.

16. An electro-optical device comprising:

the display driver as defined in claim 4;

a display panel driven by the display driver; and a controller which controls the display driver.

17. An electro-optical device comprising:

the display driver as defined in claim 8;

a display panel driven by the display driver; and a controller which controls the display driver.

18. An electro-optical device comprising:

the display driver as defined in claim 9;

a display panel driven by the display driver; and a controller which controls the display driver.

19. An electro-optical device comprising:

the display driver as defined in claim 13;

a display panel driven by the display driver; and a controller which controls the display driver.

* * * * *